US005891003A

United States Patent [19]

Deac et al.

[11] Patent Number: 5,891,003

[45] Date of Patent: Apr. 6, 1999

[54] EXERCISE DEVICE

[76] Inventors: Titus Deac; Joanna Deac, both of 674 De la Metairie, Nuns' Island, Verdun, Quebec, Canada, H3E 1T1; Charles Kwesi Collisson, 7017 Sherbrooke St. W., Apt. 7, Montreal, Canada, H4B 1R4; Alina Michelle Collisson, 937 Clifton Av., Montreal, Quebec, Canada, H4A 2N1

[21] Appl. No.: 864,368

[22] Filed: May 28, 1997

[30] Foreign Application Priority Data

May 28, 1996 [GB] United Kingdom ..... 9611102

[51] Int. Cl.[6] ..... A63B 21/065; A63B 21/002

[52] U.S. Cl. ..... 482/106; 482/110; 482/92

[58] Field of Search ..... 482/92, 121, 104, 482/105, 106, 107, 33, 34, 110

[56] References Cited

U.S. PATENT DOCUMENTS

| | | | |
|---|---|---|---|
| 405,128 | 6/1889 | Stockburger | 482/106 |
| 3,189,347 | 6/1965 | Dodge | 482/104 X |
| 3,480,274 | 11/1969 | Boggild | 482/34 |
| 3,679,107 | 7/1972 | Perrine | 482/106 |
| 4,832,334 | 5/1989 | Mullen | 482/106 |
| 4,921,246 | 5/1990 | Hornbostel | 482/106 |
| 5,050,868 | 9/1991 | Pearson | 482/104 X |
| 5,147,262 | 9/1992 | Hymanson | 482/110 |
| 5,180,349 | 1/1993 | Marcus | 482/36 |
| 5,310,394 | 5/1994 | Kallios | 482/104 |
| 5,342,272 | 8/1994 | Pitroff | 482/106 |
| 5,393,284 | 2/1995 | Wesley | 402/106 |

OTHER PUBLICATIONS

Strength & Power in Sports Blackwell Scientific Publications, 1992.

Muscle & Fitness Magazine (Photos from (1966–1968) pp. 96,117, Jul. 1997.

Body Builders Discount Outlet Catalogue (p. 31), 1994.

*Primary Examiner*—Richard J. Apley
*Assistant Examiner*—William LaMarca
*Attorney, Agent, or Firm*—Swabey Ogilvy Renault

[57] ABSTRACT

An exercise device for exercising the lower body of a person comprising an elongated spring bar which may or may not be provided with weights at the ends. A protective collar is provided centrally of the bar to permit the user to support the bar on the shoulders or on the back. The user springs up and down between an erected and squat position and the bar oscillates in phase with the user's movements such that in the squat position the bar forms a tension arc with the ends pointed downwardly while storing spring energy. As the user begins his upward movement the rebound of the bar adds initially, additional pressure on the participating muscles after which, as the tension is released and the user moves toward an erect position, the further rebound of the bar will enhance the upward movement.

24 Claims, 8 Drawing Sheets

FIG. 1
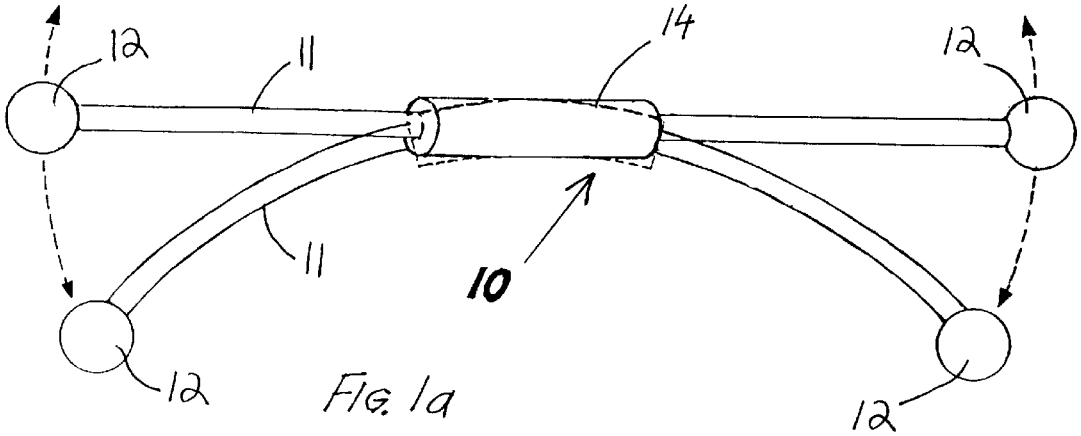
FIG. 1a
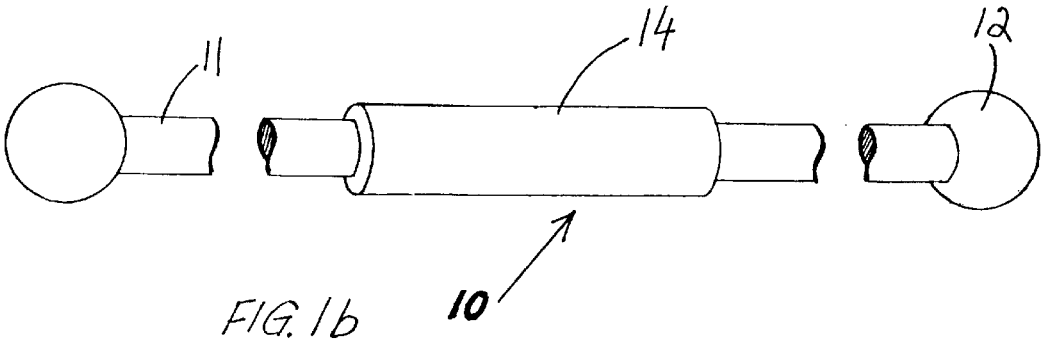
FIG. 1b
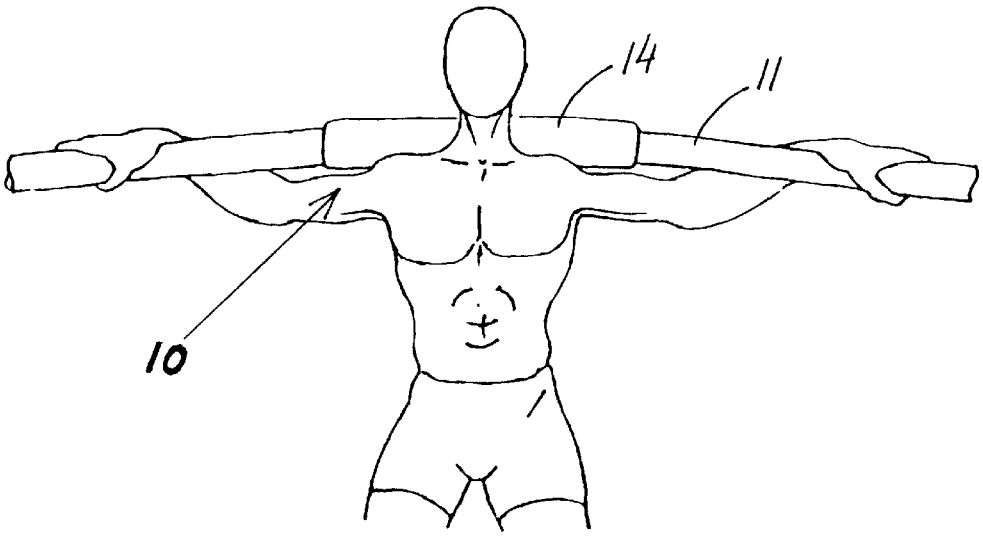
FIG. 1c

FIG. 2
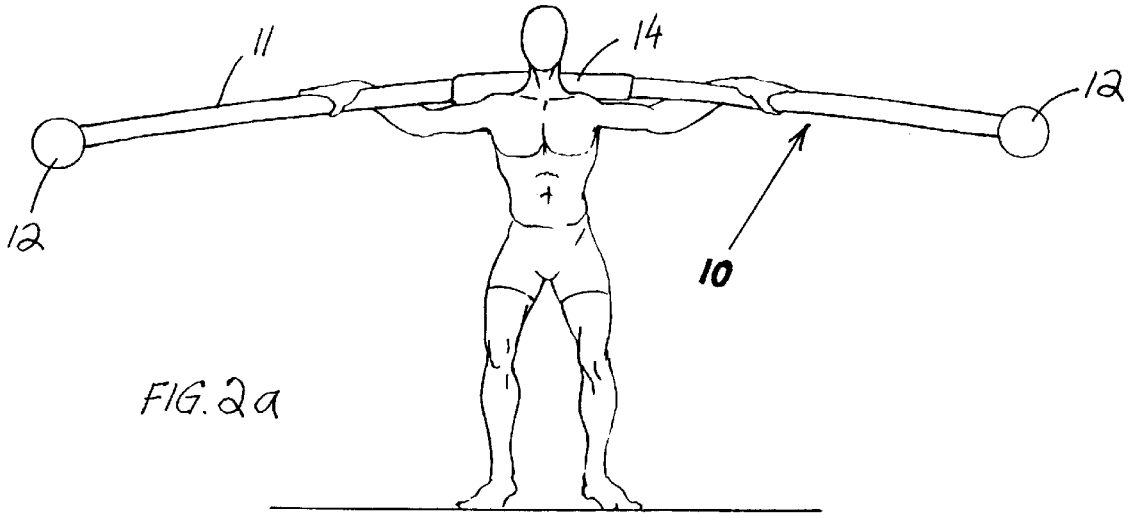
FIG. 2a
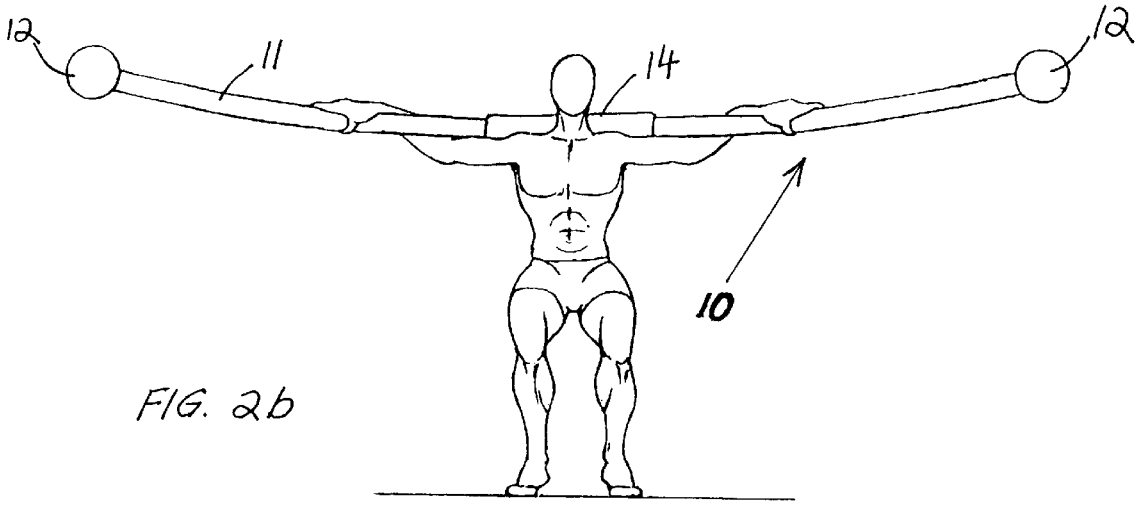
FIG. 2b
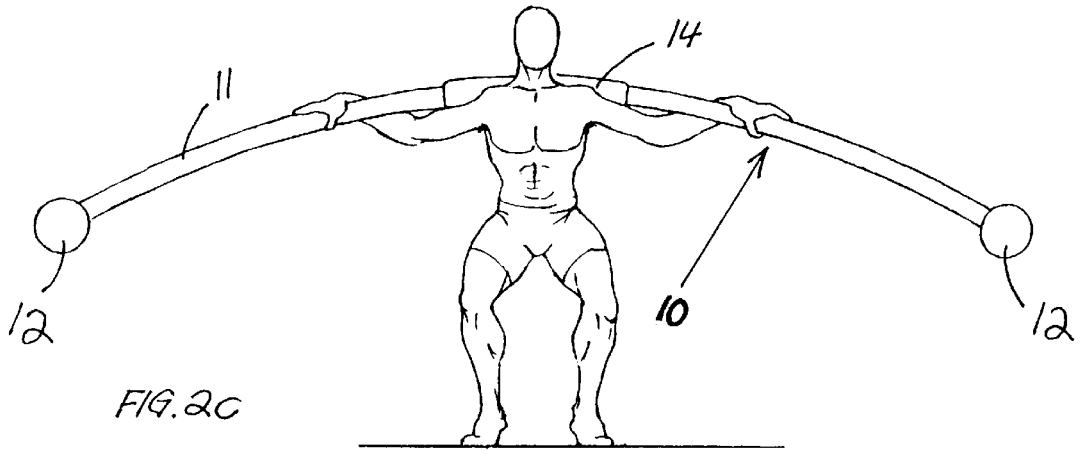
FIG. 2c

FIG. 3
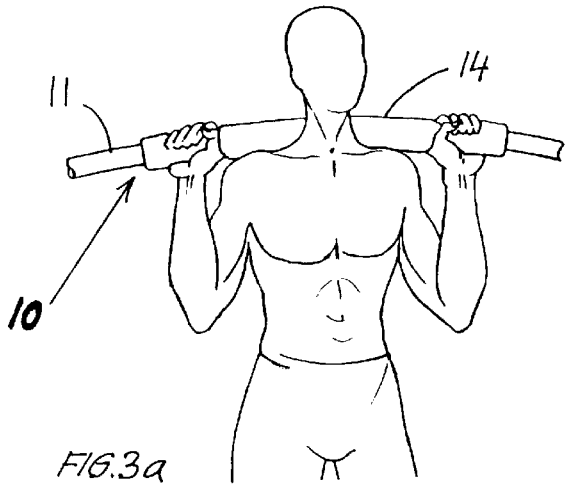
FIG.3a
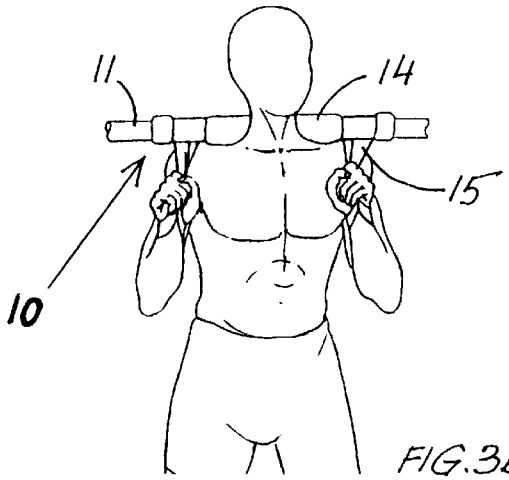
FIG.3b
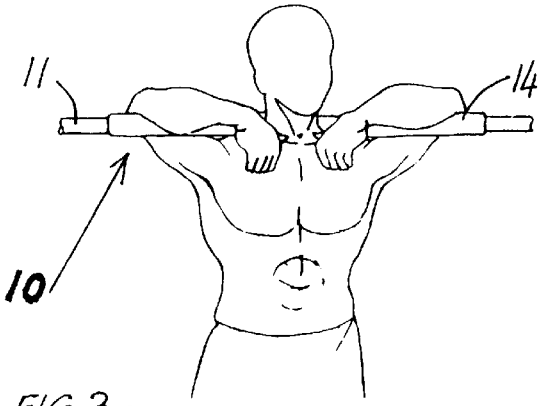
FIG.3c
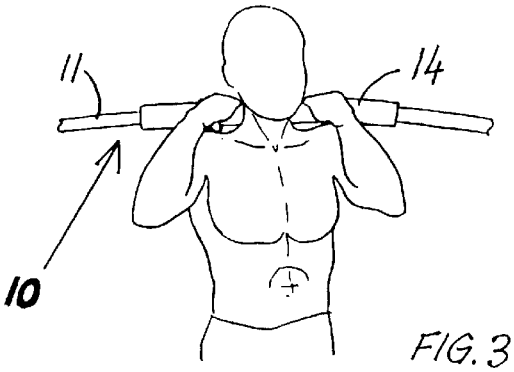
FIG.3d
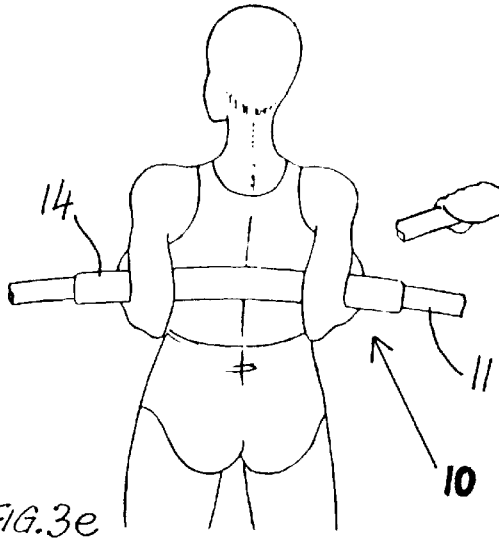
FIG.3e
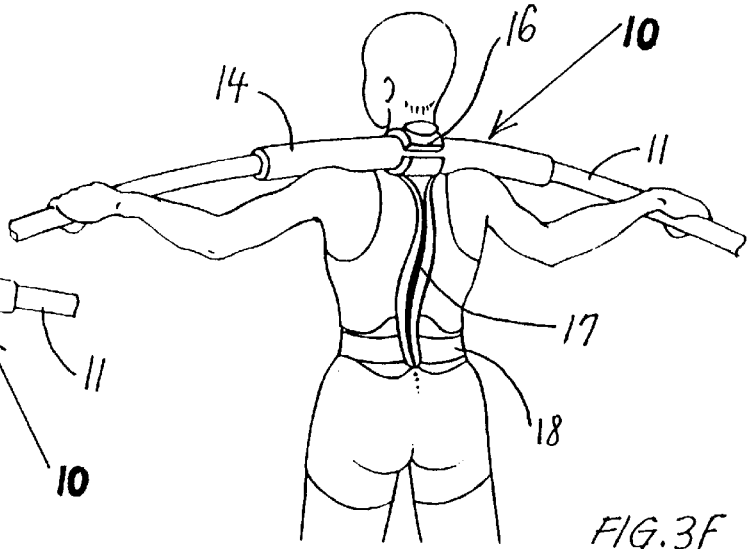
FIG.3f FIG. 4
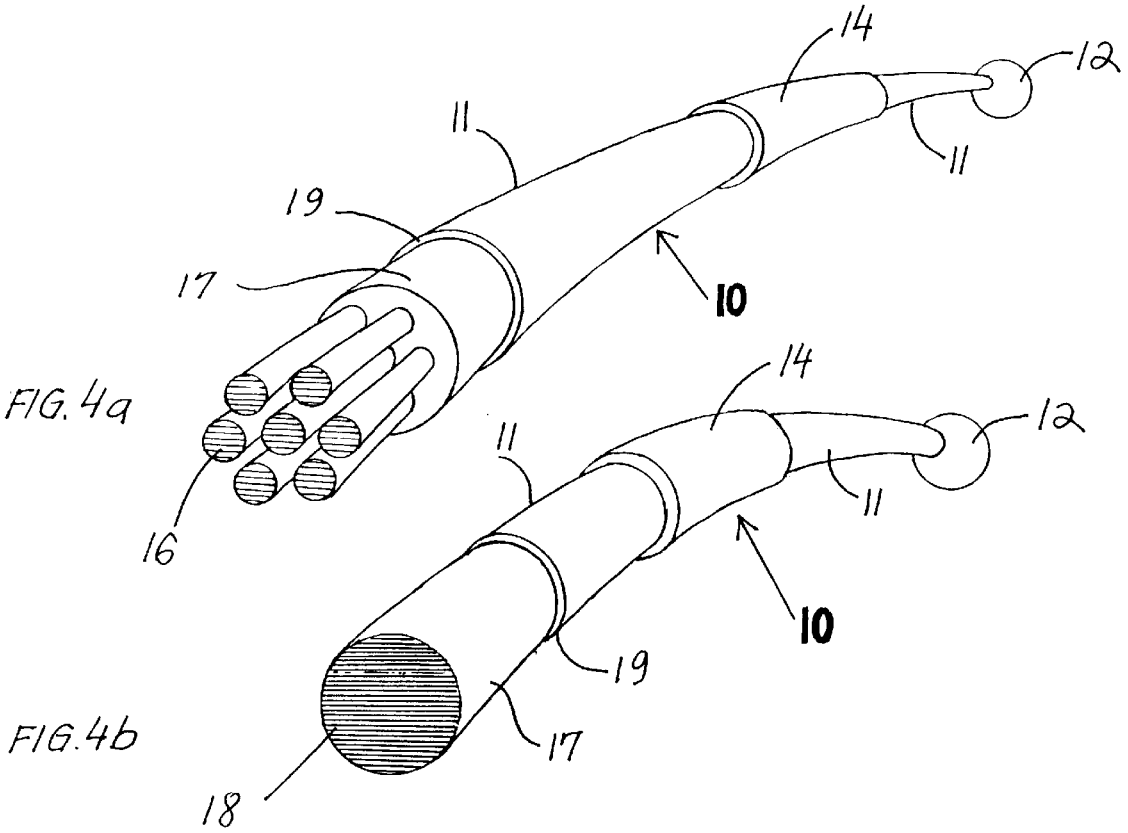
FIG. 4a
FIG. 4b
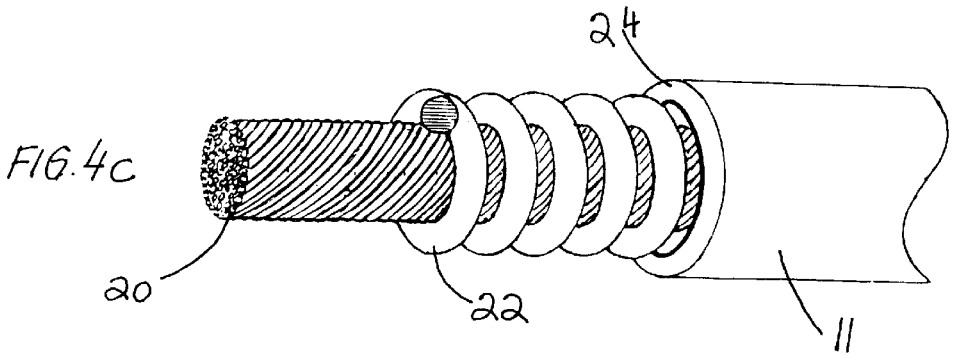
FIG. 4c
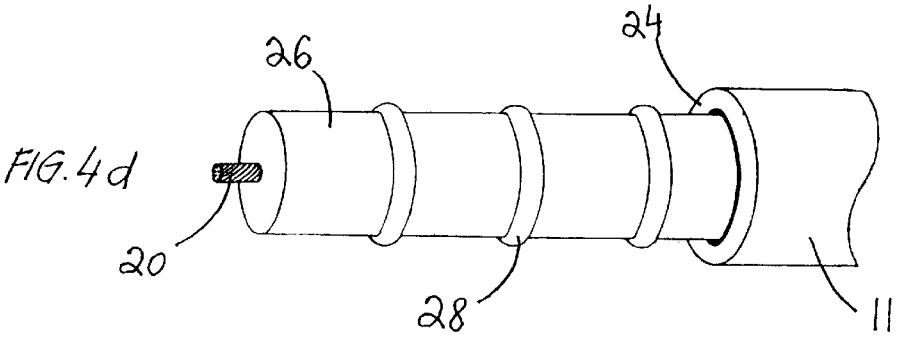
FIG. 4d FIG. 5
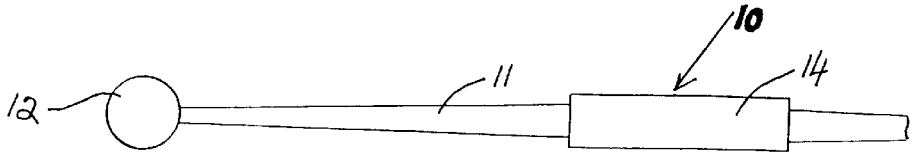
FIG.5a
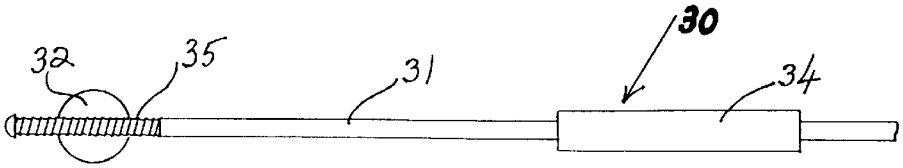
FIG.5b
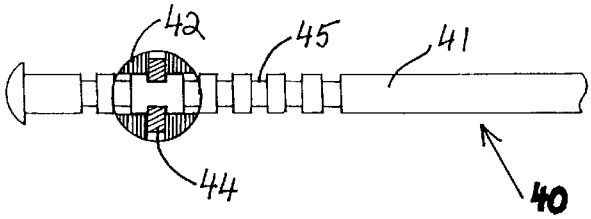
FIG.5c
FIG. 6
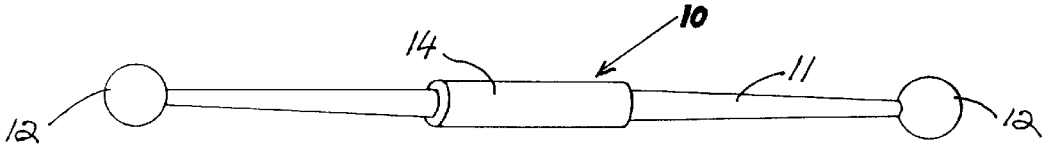
FIG.6a
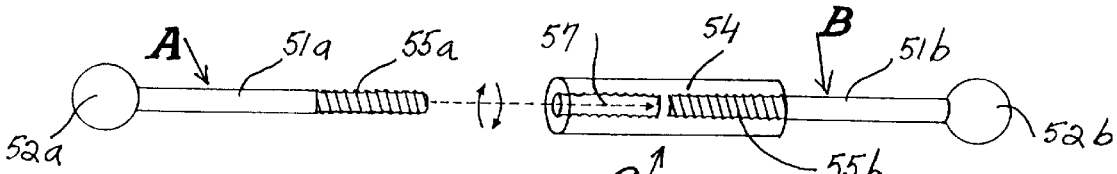
FIG. 6b
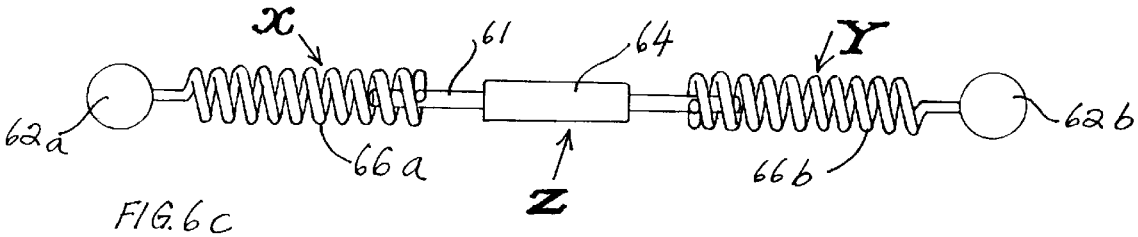
FIG.6c FIG. 7
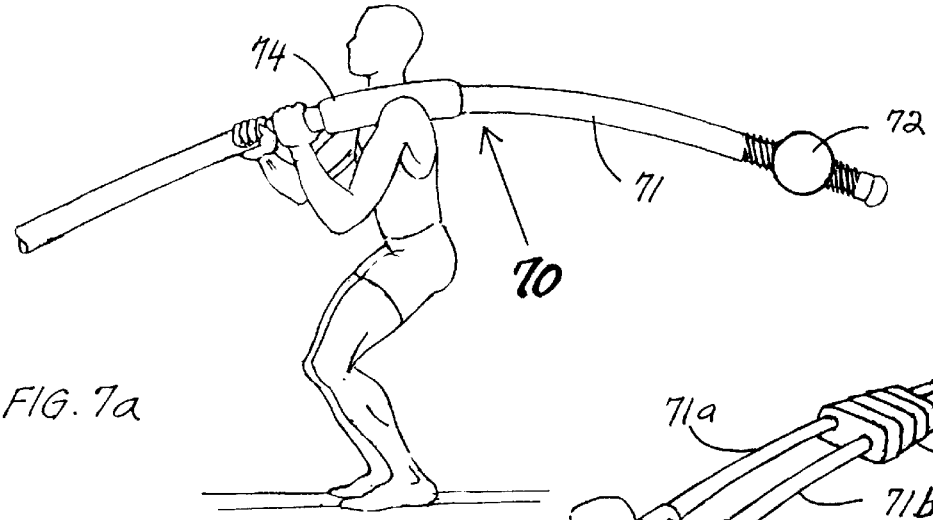
FIG. 7a
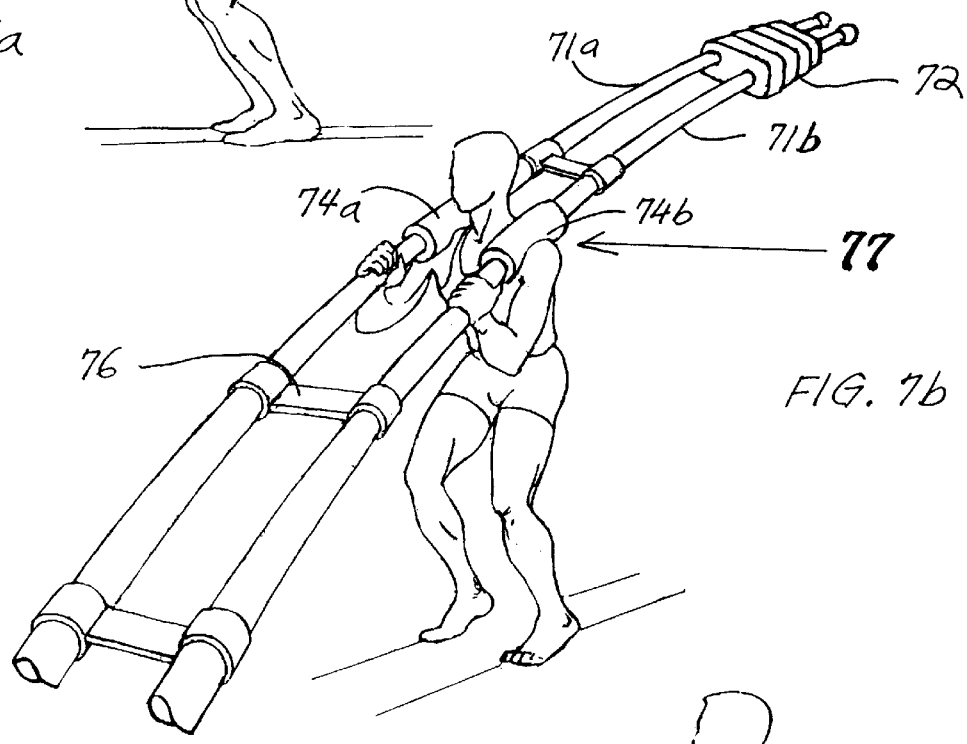
FIG. 7b
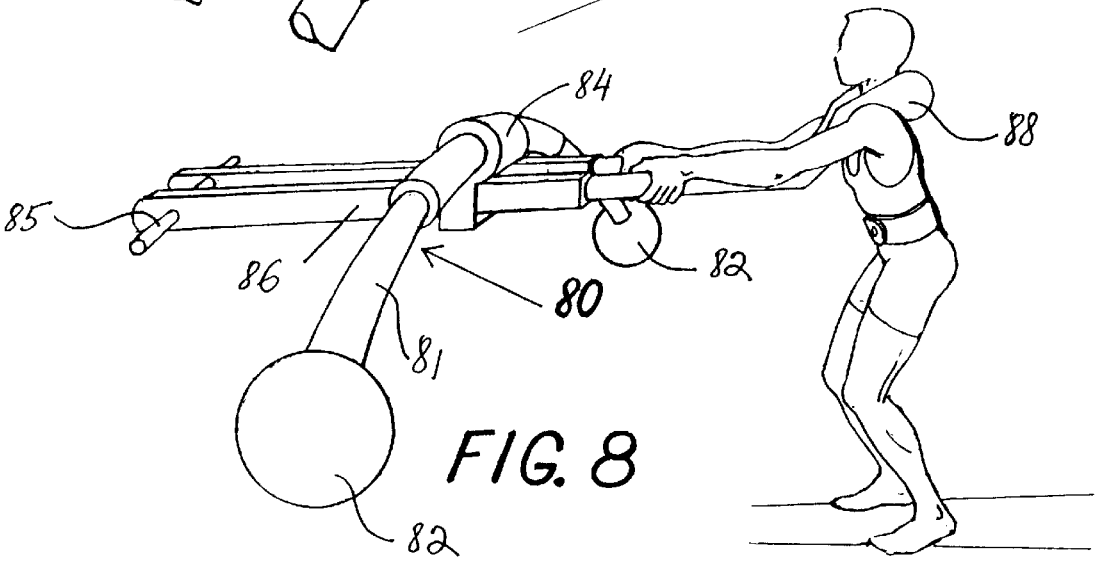
FIG. 8

EXERCISE DEVICE

BACKGROUND OF THE INVENTION

1. Field of the Invention

The present invention relates to exercise devices and more particularly to an exercise device for weight training for the purpose of developing lower body muscles and tendons and general body conditioning.

2. Description of the Prior Art

It is common in athletes to work out with weights as a means of developing the levels of strength needed in competitions. In lifting rigid weights, however, due to gravity, the velocity is generally inversely proportional with the load, that is the higher the load the lower the velocity and vice-versa. For this reason the value of lifting rigid weights as a means of muscle conditioning is less useful for certain athletic activities for which a fast, explosive type muscular power is required. On the other hand, simulating in training both the high load and the high velocity typical for competitions is desired. In this respect, for propulsion-type athletic activities like jumping and sprint running it would be advantageous if a direct relationship between the load and the velocity could be achieved so that higher speed levels characteristic for competitions could be attained when training with weights.

Based on various criteria, the literature describes different types of muscular contractions associated with the development of strength: isotonic, isometric, isokinetic, with variable resistance, plyometric etc. Insufficiently differentiated are the muscular contractions associated with decelerating and accelerating body movements, although their succession is common in running and jumping as well as in other activities.

For the purpose of this invention, the muscular activity associated with an acceleration movement is described as an "expometric" contraction, and that associated with a deceleration movement is described as an "expotonic" contraction.

For the purpose of the specification and claims the term "expotonic" refers to the muscular contractions that occur in decelerated movements and the initiation of new movements (cycles) such as flexing a member before an impulsion. An example could be the support phase in sprint running when the body inertia acts as a compounding factor in tensioning the flexing leg's muscles and tendons. In "expotonic" type muscular contractions the kinetic energy is transformed in potential energy and stored in the participating muscles and tendons.

The term "expometric" refers to muscular contractions associated with the fast release of a flexed member when a portion of the potential energy is transformed back into kinetic energy. This type of muscular activity is present in the impulsion phase of sprint running, characterized by the accelerated extension of the supporting leg. The impulsion is enhanced by the powerful eccentric work by arms and the oscillating leg, which further accelerate the motion of the entire body, facilitating the take-off.

SUMMARY OF THE INVENTION

We found that certain disadvantages in weight lifting may be overcome by using essentially flexible bars or other flexible spring bodies, capable of oscillating and, thus, of being actively bent into a succession of tensioned arcs having spring energy. The arc tension will depend on the load, the spring characteristics of the body (length, section, stiffness coefficient etc.) and the person's active movements. If weights are added to the free ends of the bar, they will also influence the tension and the oscillations of the spring body as well as the momentum of its free ends.

We have determined that working out with weights for producing enhanced "expotonic" and "expometric" muscular contractions could be achieved by using an exercise device provided with a flexible bar that can oscillate downwardly and upwardly, in phase with the person's movements, such that the bar's oscillations increase the downward pressure on the person and accelerate the person's upward motion.

More specifically, the present invention relates to an exercise device for working out with weights, operable by a person for the purpose of exercising the lower body muscles and general body conditioning, wherein the exercise device consists primarily of an essentially flexible bar or other elongated flexible spring body secured in its central segment, preferably on the shoulders or the back of the person, such that the spring body can oscillate freely in opposite directions in a mode synchronized with the person's movements.

The spring force created upon the bar being bent downwards into a tensioned arc causes the free ends to swing upwards, varying the load pressure on the person and creating a synergic force that could be used to enhance and accelerate the person's lifting motion and to turn it into a propulsion-type motion.

The ability of the spring body to oscillate makes it possible for the forces stored in the tensioned arced bar to change direction with each new oscillation, such that after a downward oriented momentum of the free ends, used to maximize both the potential energy of the spring body and the tension of the participating muscles, an upward oriented momentum could be attained, synergic with the person's weightlifting motion.

The upward oriented momentum may cause the free ends to continue their upward swing above the straight linear position of the spring body, creating a new tensioned arc, bent upwards, and the new spring energy could cause the spring body's middle point to swing upwards, lifting rather than being lifted by the person, thus further accelerating the person's upward motion.

We found that by combining the force exerted by the person to lift a weight (the external force) with the force of a tensioned arc (the inner force), in certain conditions a direct rather than inverse relationship between the load and the velocity of the movement could be achieved, such that even at higher loads, higher level of velocity, typical for competitions, could be attained. The use of spring bars allows for an impulsion-type motion, common in lifting rigid barbells, to turn into a fast, accelerated, propulsion-type lift-off motion.

The property of being flexible also makes it possible to measure the bar's strain, allowing for load and speed planning and instant measurement.

Various types of motions (long jump, high jump, sprint running, endurance running etc.) will require different amplitudes, curves, speeds and frequencies of the spring bar oscillations. These can be achieved by using materials of various compositions and elasticity characteristics (steels, alloys and other flexible metals in monofilament or multifilament bars, bundles, cables or coil springs, plastics, PVC, fiberglass, carbon, rubber, bamboo, laminated wood etc) as well as combinations of lengths, sections, weights, structures, shapes and forms.

The present method of strength development is applicable in those athletic activities where an explosive power typical for enhanced expotonic and expometric muscular contractions is required: sprint running, jumping, shotput and throwings, gymnastics, basketball, volleyball, baseball, football, hockey etc.

Both expometric and expotonic contractions also have large applicability in home fitness, school physical education and muscle rehabilitation.

BRIEF DESCRIPTION OF THE DRAWINGS

Having thus generally described the nature of the invention, reference will now be made to the accompanying drawings showing, by way of illustration, a preferred embodiment thereof, and in which:

FIG. 1*a* is a front view showing a typical spring bar in accordance with one embodiment of the present invention;

FIG. 1*b* is an enlarged fragmentary perspective view of details of the bar shown in FIG. 1*a;*

FIG. 1*c* is a fragmentary front elevation showing a typical way of securing the spring bar in FIG. 1*a* on the person's shoulders, in accordance with one embodiment of the present invention;

FIGS. 2*a* through 2*h* are front views showing a series of positions of an embodiment of the present invention being used according to the method of the present invention;

FIGS. 3*a* through 3*f* are fragmentary front views showing other ways of securing the spring bar on the person's body;

FIGS. 4*a* through 4*d* are perspective and fragmentary views partly in section of different embodiments of the spring bar of the present invention;

FIGS. 5*a* through 5*c* are fragmentary views of different types of weights used with the spring bar of the present invention;

FIGS. 6*a* through 6*c* show different embodiments of the spring bar of the present invention made of one piece or more separable segments;

FIGS. 7*a* and 7*b* show another embodiment of the present invention in different operative positions;

FIG. 8 shows a further embodiment of the present invention.

DESCRIPTION OF THE PREFERRED EMBODIMENTS

Figure 2D:
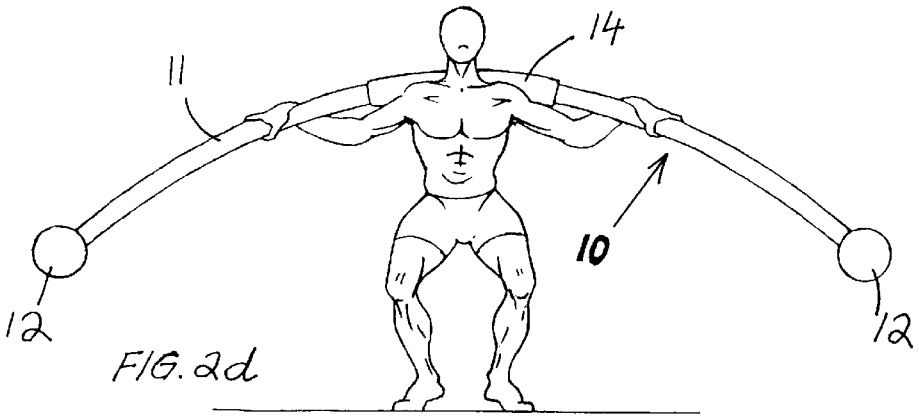

Referring now to the drawings and in particular to FIG. 1*a* there is shown an exercise device 10 made up of a spring bar 11 and weights 12, one to each end of the bar 11. A protective collar tubing 14 is provided on the central segment of the bar 11. The free ends of the bar 11 are capable of oscillating in opposite directions, thus bending the spring bar into a succession of upward and downward tensioned arcs containing spring energy.

The spring force of the tensioned arc will cause the free ends of the bar to rebound with a force proportional to the arc tension, influenced by the spring characteristics of the bar, the weights at the free ends thereof and the active movements by the person. Since the spring force changes direction with each oscillation, a downward tensioned arc could be used to create an upward oriented spring force, which could vary the bar's pressure on the person and cause an acceleration of the lifting movement.

In a bioresonance mode, i.e. a mode in which the frequency of the spring bar oscillations resonate with the frequency of the person's lifting movements, the rebound of the downward tensioned arc could impart to the free ends of the bar a momentum, enhanced by weights, which in synergy with the person's synchronized upward movement, would further accelerate that movement to the point where a propulsion type lift-off motion can result.

FIGS. 2*a* through 2*h* illustrate a typical exercise using the exercise device 10. From a standing position, the spring bar 11 is secured horizontally, by both arms, on the person's shoulders, as shown in Fig. 2*a*. When the person flexes his knees to execute a squat, this downward motion will tension the spring bar 11, as shown in FIG. 2*b,* causing its free ends to oscillate downwardly. The downward bending of the spring bar 11 will initially act as a shock absorber since the free ends of the spring bar 11 will continue their downward oscillation after the person's squat has ended, as shown in FIG. 2*c*.

While the free ends of the spring bar 11 continue their downward oscillation, decelerated by the increasing spring forces in the tensioned bar, the person will begin the upward lifting motion, as shown in FIG. 2*d,* causing initially further tensioning of the strained arc. In this phase, the person's lifting motion is opposite to the downward movement of the bar's free ends, and thus the maximum tensioning of the arc takes place. As the tensioned bar 11 is secured to the person's body, the tension in the arc will be transferred gradually to the person's lower body, causing expotonic contractions to take place in the participating muscles.

Figure 2E:
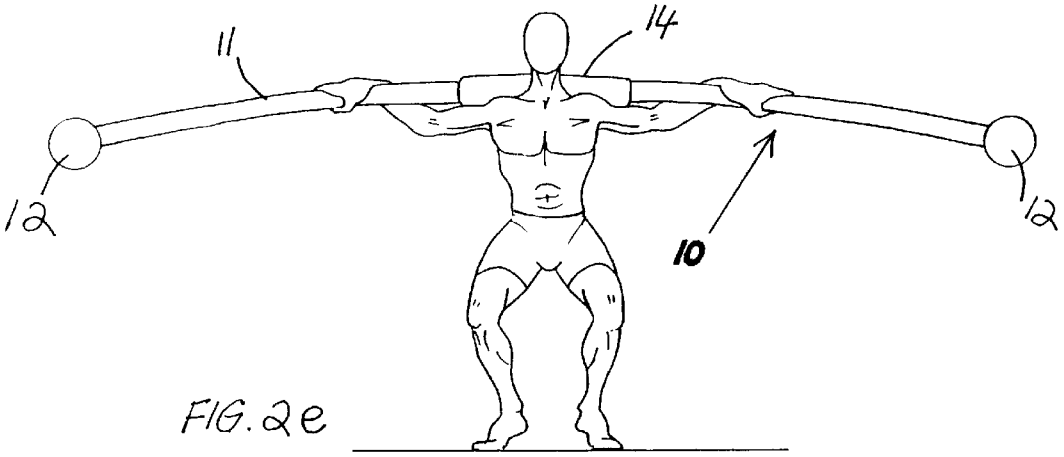

When the spring force created in the tensioned arc exceeds the downward momentum, the upward rebound of the bar's free ends will begin. In the first part of the rebound, the free ends of the bar 11 accelerate upward, causing the middle segment of the bar 11 to exert continuing downward pressure on the person, as shown in FIG. 2*e*.

Figure 2F:
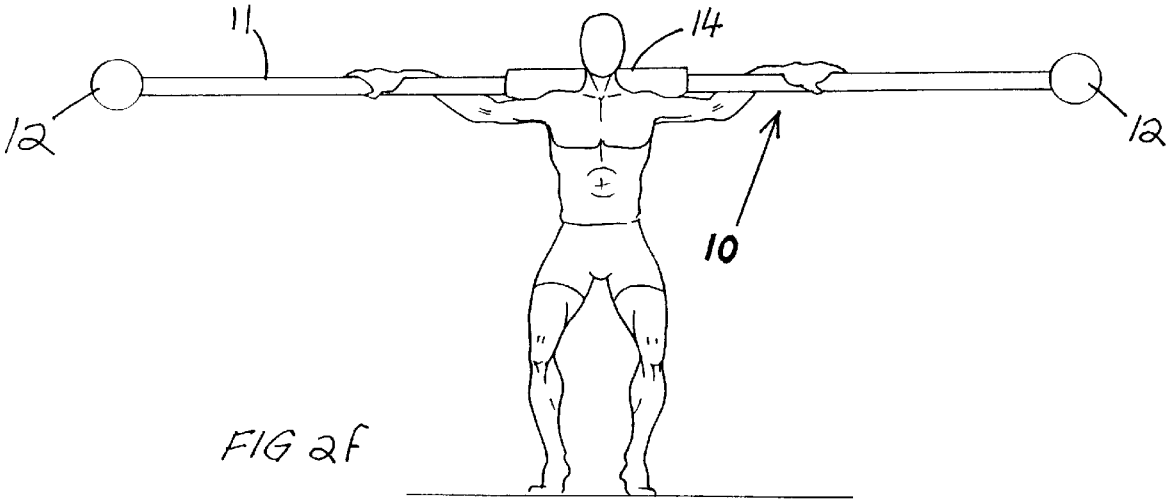

The further upward oscillation will cause a gradual reduction of the bar's downward pressure, creating conditions for accelerating the lifting motion by the person, and this is exemplified in FIG. 2*f*.

Figure 2G:
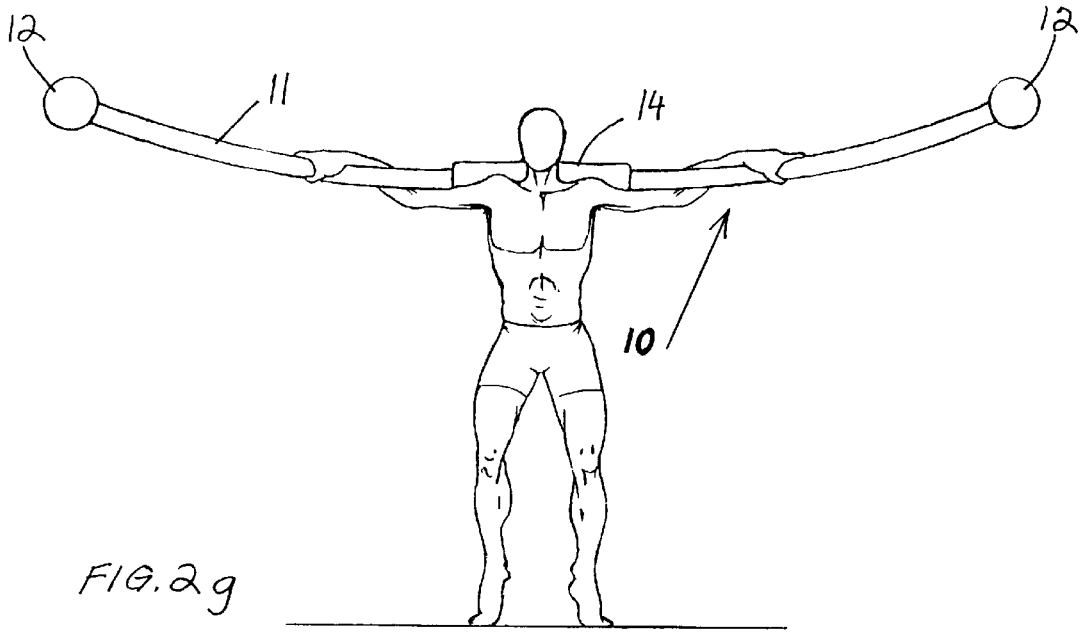

A powerful momentum may cause a continuation of the bar's upward oscillation and the formation of a new arc, oriented upward, as shown in FIG. 2*g*.

Figure 2H:
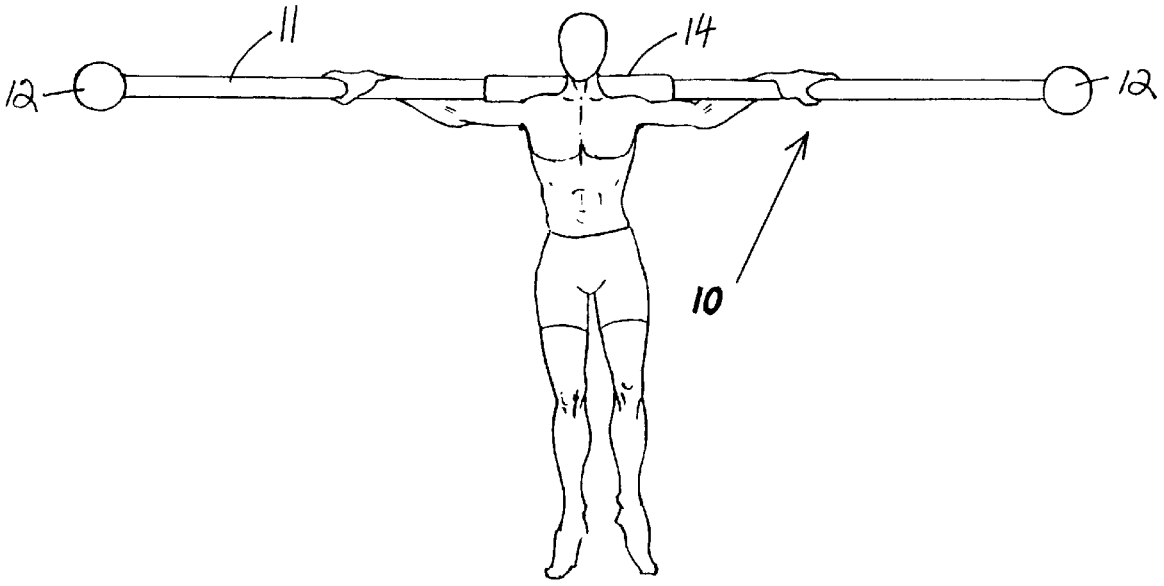

Finally, as shown in FIG. 2*h,* a synergic upward rebound of the middle segment of the spring bar 11 will take place, creating conditions for strong expometric type contractions in the participating muscles and further acceleration of the person's lifting motion.

FIGS. 3*a* through 3*f* show various ways of securing the spring bar to the person's body such as to obtain sufficiently ample oscillations in shorter spring bars typical for home exercises.

In FIG. 3*a* the spring bar is secured on the person's shoulders by arms, palms oriented upward/forward, similar to the classic holding of a rigid barbell. In FIG. 3*b,* a tight holding behind the person's neck is achieved by way of handles secured to the bar.

In FIG. 3*c* the bar is "locked" behind the person's neck by his forearms flexed over and downward around the bar's collar tubing. In FIG. 3*d* the "locked" position behind the person's neck is achieved by hands, palms oriented downward/backward.

In FIG. 3*e* the bar is "locked" behind the person's waist, by the forearms flexed below and forward around the the bar's collar tubing. In FIG. 3*f* an assisting device of the type "neck-belt-vest" is used to secure the bar on the person's back behind his neck.

FIGS. 4*a* through 4*d* show four embodiments of different types of spring bar constructions. For instance, in FIGS. 4*a* and 4*b* monofilament cables bundled 16 or single 18 and made of different spring materials are extruded in an elastomeric cylinder 17 covered by a protective sleeve or spring tubing 19 to form the body of the bar 11. A central collar tubing 14 is also provided. A fixed weight 12 is mounted to each end of the bar 11.

In the embodiment shown in FIG. 4*c* a spaced coil spring 22 is rolled around a thick multifilament cable 20 to form an elastomeric cylinder inserted into a tube 24 made of spring material to form the body of the spring bar 11.

In the embodiment shown in FIG. 4*d* succession of rigid "vertebrae" 26 made of heavy material and disks 28 made of rubber or other flexible material are threaded on a multifilament cable 20 to form an elastomeric cylinder inserted into a tube 24 made of spring material to form the body of the bar 11.

The weight of the exercise device is relatively heavy since it is meant to develop the strength of the lower body muscles. Different weights, however, will be necessary for the development of different muscles at different velocities. For instance, heavier weights will be necessary for the development of the larger thigh muscles while for the development of the smaller ankle and foot muscles lighter weights may be appropriate.

FIGS. 5*b* and 5*c* show examples of exercisers with adjustable weights attached to a spring bar of a constant diameter, compared to an exerciser with fixed weights attached to a spring bar with a variable diameter, shown in FIG. 5*a*.

For example in FIG. 5*b* the exercise device 30 includes a spring rod 31 on which threads 35 have been formed. The end weight 32 is adjustable along a portion of the length of rod 31. FIG. 5*c* illustrates a similar exercise device 40 provided with threads 45 and an end weight 42, secured to the rod 41 by pliers 44.

The exercise device of the present invention could consist of a single compact piece that includes the flexible bar 11 provided with the collar tubing 14 and the fixed end weights 12, as shown in FIG. 6*a*. Alternatively, the exercise device could be made of two or more separable pieces, assembled into one single device only for the purpose of exercising.

For example, FIG. 6*b* shows an exercise device composed of several separable pieces or segments in which the separable segment A consisting of the spring bar 51*a* and provided with the thread 55*a* and end weight 52*a* is mounted into the central segment C, consisting of a threaded cylinder 57 and covered by the collar tubing 54, and in which the separable segment B, identical with the segment A, has already been mounted. In each of the identical segments A and B the end weights 52*a* and 52*b* could also be separable and connected to the spring bars 51*a* and 51*b*, through threads or other means, for the purpose of exercising.

Another example is shown in FIG. 6*c* in which the separable central segment Z is mounted into the separable identical segments X and Y, in which the end weights 62*a* and 62*b* could also be separable.

FIGS. 7*a* and 7*b* illustrate another embodiment of the present invention where the exercise devices 70 and 77 consist of a single spring bar 70 or a pair of parallel bars 71*a* and 71*b* connected together by spacer rods 76. End weights 72, fixed or adjustable, are mounted to the only free end of the bar 70 or pairs of bars 71*a* and 71*b*. The other end is secured through a hinge-type mechanism at or above the ground level, allowing for radial-type vertical movements of the exercise devices 70 and 77, supported on the shoulders of the person by means of padded collar tubings 74, and 74*a* and 74*b* respectively.

In another embodiment of the present invention, as shown in FIG. 8, an exercise device 80 is shown which can be utilized for larger weights. In this case the exercise device includes a flexible bar 81 provided with end weights 82 and a sleeve 84 that mounts the bar 81 to a lever 86 pivotally mounted to a supporting frame at pivot 85. A harness 88 would be engaged by the person to raise and lower the lever 86 to which the exercise device 80 would be mounted.

The overall length of the bar is generally a function of the amplitude of oscillations sought to be obtained, which are also influenced by the specific way the spring bar is attached to the person's body. For most applications the bar's length will exceed eight feet such as to obtain ample oscillations of its free ends, capable of being synchronized with the person's lower body movements in a "bioresonance" mode.

As a general rule, the oscillations should be much ampler than simple vibrations since it is the tensioned arc synergy, proportional with the amplitude of its oscillations, that is being sought. There is, however, a large range of the oscillations amplitude that could usefully match an equally large range of the person's lower body motions, depending on what exactly the exercise seeks to develop. For example, ampler oscillations will be needed for the development of the larger thigh muscles, generally engaged in larger ROM's ("range of motion"), while less ample oscillations will be appropriate for the development of the ankle and foot muscles, comparably engaged in reduced ROM's.

Also, probably ampler oscillations will be sought by a high-jumper, basketball or volleyball player and less ample oscillations by a sprint runner, long-jumper, baseball or football player. However, since the exercise device proposed in the present invention addresses the combined motions of the lower body as a whole (feet, legs, thighs), generally, relatively ample oscillations of the spring bar, without active movements by person's arms, will be typical of its use, as opposed to simple vibrations.

In a specific example, an exercise device designed for use by an experienced athlete would include a spring bar of between 8 and 18 feet in length with a diameter of between ½" and 3" and with a weight of between 20 lbs and 200 lbs, generally of the type shown in FIGS. 2. The bar may or may not have weights at or toward the ends thereof. Generally, at constant flexibility characteristics, the shorter the length of the bar the more will weights be needed at its ends in order to produce sufficient arc tension and amplitude for the purpose of the exercise.

Another version of the proposed exercise device, useful for training by junior athletes, would be a thinner spring bar slightly longer than 8 ft, provided with fixed or adjustable weights at the ends thereof, so that the total weight would be between 10 and 60 lbs.

Shorter and lighter spring bars will also be useful in home work-outs for general body conditioning, in which sufficient amplitude could be obtained by "locking" the bar's central segment to the person's body by hands, arms, handles or "neck-belt-vest" assisting devices, as shown in FIGS. 3. By immobilizing both the middle segment of the spring bar and the person's arms in a tight grip, a better interaction between the bar's spring energy and the person's lower body movements could be achieved, that will allow for prolonged series of successive expotonic and expometric muscular contractions to be maintained (that is aerobic series of vertical bounds on one or both feet).

We claim:

1. A bioresonance apparatus for exercising the lower body of a person, the apparatus comprising:

an elongated member having a central support portion and a pair of oppositely extending end portions making up the length of the elongated member, the elongated member being made of a plurality of flexible spring elements extending throughout the length of at least the end portions thereof, the plurality of spring elements including at least a coil spring element of resilient flexible material extending through at least each of said end portions to form a flexible resilient member capable of bowing and of producing cyclical upwardly and downwardly oriented oscillations of said end portions, wherein said cyclical oscillations may be synchronized with a cycle of lower body movements of the person exercising, from an erect position to a squat position and back to an erect position, such that the resistance exerted on the person is increased by the downward oscillations and reduced by the upward oscillations for the purpose of achieving an accelerated upward motion by the person.

2. A bioresonance apparatus for exercising the lower body of a person, the apparatus comprising:

an elongated member having a central support portion and a pair of oppositely extending end portions making up the length of the elongated member, the elongated member being made of a plurality of flexible spring elements extending throughout the length of at least the end portions thereof, the plurality of spring elements including at least a plurality of monofilament cables bundled together and extending through at least each of said end portions to form a flexible resilient member capable of bowing and of producing cyclical upwardly and downwardly oriented oscillations of said end portions, wherein said cyclical oscillations may be synchronized with a cycle of lower body movements of the person exercising, from an erect position to a squat position and back to an erect position, such that the resistance exerted on the person is increased by the downward oscillations and reduced by the upward oscillations for the purpose of achieving an accelerated upward motion by the person.

3. The bioresonance apparatus as defined in claim 1, wherein the central support portion includes support means for supporting the elongated member on the shoulders or back of the person.

4. The bioresonance apparatus as defined in claim 3, wherein the support means includes means for attaching the elongated member to the shoulders or back of the person.

5. The bioresonance apparatus as defined in claim 4, wherein the support means is in the form of a protective collar sleeve.

6. The bioresonance apparatus as defined in claim 1, wherein the elongated member extends between 8 and 18' in length and weighs between 20 lbs. and 200 lbs.

7. The bioresonance apparatus as defined in claim 1, wherein the elongated member extends to approximately 8' in length and weighs between 10 lbs. and 60 lbs.

8. The bioresonance apparatus as defined in claim 2, wherein said monofilament cables are bundled in an elastomeric cylinder.

9. The bioresonance apparatus as defined in claim 1, wherein the spring elements of the elongated member also comprise a core made up of a multifilament cable within said coil spring, the coil spring being surrounded by at least a tube made of spring material.

10. The bioresonance apparatus as defined in claim 1, wherein the elongated member mounts weights at the free end thereof to enhance the oscillation thereof.

11. The bioresonance apparatus as defined in claim 1, wherein the spring elements of the elongated member include a single monofilament element surrounded by said coil spring which is then enveloped by a tubular cover.

12. The bioresonance apparatus as defined in claim 1, wherein the spring elements of the elongated member provide characteristics of flexibility and resilience and the spring elements are made of material selected from rubber, PVC, metal sheets, spring coils, fiberglass, and plastics.

13. The bioresonance apparatus as defined in claim 1, wherein the central support portion includes a bracket for attaching the elongated member at the central support portion thereof to a supporting exercise device.

14. The bioresonance apparatus as defined in claim 2, wherein the central support portion includes support means for supporting the elongated member on the shoulders or back of the person.

15. The bioresonance apparatus as defined in claim 2, wherein the elongated member extends between 8 and 18' in length and weighs between 20 lbs. and 200 lbs.

16. The bioresonance apparatus as defined in claim 2, wherein the elongated member mounts weights at the free end thereof to enhance the oscillation thereof.

17. The bioresonance apparatus as defined in claim 2, wherein the spring elements of the elongated member provide characteristics of flexibility and resilience, and the spring elements are made of material selected from rubber, PVC, metal sheets, spring coils, fiberglass, and plastics.

18. The bioresonance apparatus as defined in claim 2, wherein the central support portion includes a bracket for attaching the elongated member at the central support portion thereof to a supporting exercise device.

19. A bioresonance apparatus for exercising the lower body of a person, the apparatus comprising:

an elongated member having a central support portion and a pair of oppositely extending end portions making up the length of the elongated member, the elongated member being made of a plurality of flexible spring elements extending throughout the length of at least the end portions thereof, the plurality of spring elements of the elongated member including at least one multifilament cable forming a core surrounded by a longitudinal series of rigid jackets interspersed by elastomeric discs, the whole surrounded by at least one spring tube and extending through at least each of said end portions to form a flexible resilient member capable of bowing and of producing cyclical upwardly and downwardly oriented oscillations of said end portions, wherein said cyclical oscillations may be synchronized with a cycle of lower body movements of the person exercising, from an erect position to a squat position and back to an erect position, such that the resistance exerted on the person is increased by the downward oscillations and reduced by the upward oscillations for the purpose of achieving an accelerated upward motion by the person.

20. The bioresonance apparatus as defined in claim 19, wherein the central support portion includes support means for supporting the elongated member on the shoulders or back of the person.

21. The bioresonance apparatus as defined in claim 19, wherein the elongated member extends between 8 and 18' in length and weighs between 20 lbs. and 200 lbs.

22. The bioresonance apparatus as defined in claim 19, wherein the elongated member mounts weights at the free end thereof to enhance the oscillation thereof.

23. The bioresonance apparatus as defined in claim 19, wherein the spring elements of the elongated member provide characteristics of flexibility and resilience, and the spring elements are made of material selected from rubber, PVC, metal sheets, spring coils, fiberglass, and plastics.

24. The bioresonance apparatus as defined in claim 19, wherein the central support portion includes a bracket for attaching the elongated member at the central support portion thereof to a supporting exercise device.

* * * * *